US009200348B2

(12) United States Patent
Kim et al.

(10) Patent No.: US 9,200,348 B2
(45) **Date of Patent: *Dec. 1, 2015**

(54) ALUMINUM ALLOY AND MANUFACTURING METHOD THEREOF

(75) Inventors: Shae-Kwang Kim, Seoul (KR); Jin-Kyu Lee, Incheon (KR); Min-Ho Choi, Chungcheongbuk-do (KR); Jeong-Ho Seo, Seoul (KR)

(73) Assignee: KOREA INSTITUTE OF INDUSTRIAL TECHNOLOGY, Cheonan (KR)

( * ) Notice: Subject to any disclaimer, the term of this patent is extended or adjusted under 35 U.S.C. 154(b) by 759 days.

This patent is subject to a terminal disclaimer.

(21) Appl. No.: 12/949,152

(22) Filed: Nov. 18, 2010

(65) Prior Publication Data

US 2011/0123390 A1 May 26, 2011

(30) Foreign Application Priority Data

Nov. 20, 2009 (KR) ..... 10-2009-0112872
Jul. 13, 2010 (KR) ..... 10-2010-0067494

(51) Int. Cl.

| | |
|---|---|
| ***B22D 27/00*** | (2006.01) |
| ***C22C 1/03*** | (2006.01) |
| ***C22C 21/00*** | (2006.01) |
| ***C22C 1/02*** | (2006.01) |
| ***C22C 21/02*** | (2006.01) |
| ***C22C 21/06*** | (2006.01) |
| ***C22C 21/08*** | (2006.01) |
| ***C22C 21/10*** | (2006.01) |
| ***C22C 21/12*** | (2006.01) |

(52) U.S. Cl.
CPC . *C22C 1/026* (2013.01); *C22C 1/03* (2013.01); *C22C 21/00* (2013.01); *C22C 21/02* (2013.01); *C22C 21/06* (2013.01); *C22C 21/08* (2013.01); *C22C 21/10* (2013.01); *C22C 21/12* (2013.01)

(58) Field of Classification Search
CPC ..... B22D 27/00; C22C 1/02; C22C 1/03; C22C 21/00; C22C 21/06
USPC ..... 164/55.1, 57.1; 420/590
See application file for complete search history.

(56) References Cited

U.S. PATENT DOCUMENTS

| | | | | |
|---|---|---|---|---|
| 3,567,429 | A | 3/1971 | Dunkel et al. | |
| 3,926,690 | A | 12/1975 | Morris et al. | |
| 4,286,984 | A * | 9/1981 | Luyckx | 75/303 |
| 4,929,511 | A * | 5/1990 | Bye et al. | 428/606 |
| 5,074,936 | A * | 12/1991 | Hazelton | 148/403 |
| 6,412,164 | B1 * | 7/2002 | DeYoung et al. | 29/527.5 |
| 9,080,225 | B2 * | 7/2015 | Kim et al. | 164/57.1 |
| 2005/0011591 | A1 | 1/2005 | Murty et al. | |
| 2007/0178006 | A1 * | 8/2007 | Saikawa et al. | 420/407 |

(Continued)

FOREIGN PATENT DOCUMENTS

| | | | |
|---|---|---|---|
| CN | 1469936 | A | 1/2004 |
| EP | 0774521 | A1 | 5/1997 |

(Continued)

OTHER PUBLICATIONS

Notice of Allowance for Korean Application No. 10-2010-0067494 dated Oct. 26, 2012.

*Primary Examiner* — Kevin P Kerns

(57) ABSTRACT

Provided are an aluminum alloy and a manufacturing method thereof. In the method, aluminum and a master alloy containing a calcium (Ca)-based compound are provided. A melt is prepared, in which the master alloy and the Al are melted. The aluminum alloy may be manufactured by casting the melt.

24 Claims, 9 Drawing Sheets

(56) References Cited

U.S. PATENT DOCUMENTS

| | | | | |
|---|---|---|---|---|
| 2008/0187454 | A1* | 8/2008 | Tanizawa et al. | 420/407 |
| 2011/0123391 | A1* | 5/2011 | Kim et al. | 420/533 |

FOREIGN PATENT DOCUMENTS

| | | | |
|---|---|---|---|
| JP | 53-125918 | A | 11/1978 |
| JP | 06-145865 | | 5/1994 |
| JP | 06-306521 | | 11/1994 |
| JP | 2006-257478 | A | 9/2006 |
| JP | 2006-322062 | A | 11/2006 |
| KR | 1020060094734 | A | 8/2006 |
| KR | 10-0681539 | | 2/2007 |
| WO | 02/30822 | A2 | 4/2002 |
| WO | 2010079677 | A1 | 7/2010 |

* cited by examiner (a)

(b)

(a)

(b)

(a)

(b)

(a)

(b)

ALUMINUM ALLOY AND MANUFACTURING METHOD THEREOF

CROSS-REFERENCE TO RELATED PATENT APPLICATION

This application claims the benefit of Korean Patent Application Nos. 10-2009-0112872 filed on Nov. 20, 2009 and 10-2010-0067494 filed on Jul. 13, 2010 in the Korean Intellectual Property Office, the disclosure of which is incorporated herein in its entirety by reference.

BACKGROUND

1. Field of the Invention

The present invention relates to an aluminum alloy and a manufacturing method thereof.

2. Description of the Related Art

Magnesium (Mg) is currently one of the main alloying elements in an aluminum (Al) alloy. The addition of Mg increases the strength of aluminum alloy, makes the alloy favorable to surface treatment, and improves corrosion resistance. However, there is a problem in that the quality of a molten aluminum may be deteriorated due to the fact that oxides or inclusions are mixed into the molten aluminum during alloying of magnesium in the molten aluminum because of a chemically high oxidizing potential of magnesium. In order to prevent oxides or inclusions from being mixed into the molten aluminum due to the addition of magnesium, a method of covering the melt surface with a protective gas such as $SF_6$ may be used during the addition of magnesium.

However, it is difficult to perfectly protect magnesium, which is massively added during the preparation of an aluminum alloy, using a protective gas. Furthermore, $SF_6$ used as the protective gas is not only an expensive gas but also a gas causing an environmental problem, and thus the use of $SF_6$ is now being gradually restricted all over the world.

SUMMARY OF THE INVENTION

The present invention provides an aluminum alloy which is manufactured in an environment-friendly manner and has excellent alloy properties, and a manufacturing method of the aluminum alloy. Also, the present invention provides a processed product using the aluminum alloy.

According to an aspect of the method, there is provided a method of manufacturing an aluminum (Al) alloy. A magnesium (Mg) master alloy containing a calcium (Ca)-based compound and Al are provided. A melt is formed in which the Mg master alloy and the Al are melted. The melt is cast.

According to another aspect of the method, the magnesium master alloy may be manufactured by adding a calcium-based additive to a parent material of magnesium or a magnesium alloy. Further, the magnesium alloy may include aluminum. Still further, manufacturing the magnesium master alloy comprises forming a molten parent material by melting the parent material and adding the calcium-based additive into the molten parent material.

According to another aspect of the method, manufacturing the magnesium master alloy comprises melting the parent material and the calcium-based additive together.

According to another aspect of the method, the calcium-based additive may be reduced from the molten magnesium, and the calcium-based compound may include at least one of a Mg—Ca compound, an Al—Ca compound, and a Mg—Al—Ca compound.

According to another aspect of the method, the method may further include adding iron (Fe) in an amount less than or equal to about 1.0% by weight (more than 0).

An aluminum alloy according to an aspect of the present invention may be an aluminum alloy which is manufactured by the method according to any one of above-described methods.

An aluminum alloy according to an aspect of the present invention may include an aluminum matrix; and a calcium-based compound existing in the aluminum matrix, wherein magnesium is dissolved in the aluminum matrix.

According to another aspect of the aluminum alloy, the aluminum matrix may have a plurality of domains which form boundaries therebetween and are divided from each other, wherein the calcium-based compound exists at the boundaries. For example, the domains may be grains, and the boundaries may be grain boundaries. For another example, the domains may be phase regions defined by phases different from each other, and the boundaries may be phase boundaries.

According to another aspect of the aluminum alloy, the calcium-based compound may include at least one of a Mg—Ca compound, an Al—Ca compound, and a Mg—Al—Ca compound. Further, the Mg—Ca compound may include $Mg_2Ca$, the Al—Ca compound may include at least one of $Al_2Ca$ and $Al_4Ca$, and the Mg—Al—Ca compound may include $(Mg, Al)_2Ca$.

According to another aspect of the aluminum alloy, the aluminum alloy may include iron (Fe) in an amount less than or equal to about 1.0% by weight (more than 0%).

According to another aspect of the aluminum alloy, the aluminum alloy may have a domain having an average size that is smaller than another aluminum alloy that does not contain the calcium-based compound, but which is otherwise manufactured under the same conditions.

According to another aspect of the aluminum alloy, the aluminum alloy has a tensile strength greater than another aluminum alloy that does not contain the calcium-based compound, but which is otherwise manufactured under the same conditions.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, the present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

According to an embodiment of the present invention, a master alloy with a predetermined additive is prepared, and thereafter an aluminum alloy is manufactured by adding the master alloy into aluminum. The master alloy may use pure magnesium or magnesium alloy as parent material, and all of these are denoted as a magnesium master alloy.

In this embodiment, pure magnesium, into which alloying elements have not been added intentionally, is defined as encompassing magnesium which contains impurities introduced unavoidably or unintentionally during the manufacture of magnesium. On the contrary, a magnesium alloy is an alloy manufactured by intentionally adding other alloying elements such as aluminum into magnesium. The magnesium alloy containing aluminum as an alloying element may be called a magnesium-aluminum alloy. This magnesium-aluminum alloy may include not only an aluminum as an alloying element, but also other alloying elements.

Figure 1:
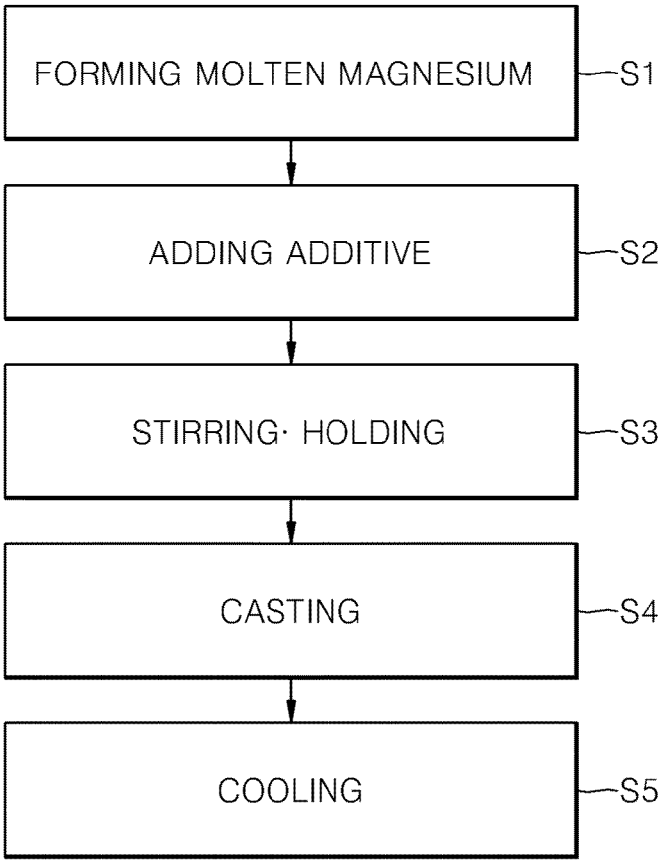
FIG. 1 is a flowchart illustrating an embodiment of a method of manufacturing a magnesium master alloy to be added into a molten aluminum during the manufacture of an aluminum alloy according to embodiments of the present invention.

FIG. 1 is a flowchart showing a manufacturing method of magnesium master alloy in a manufacturing method of aluminum alloy according to an embodiment of the present invention. Pure magnesium or magnesium alloy may be used as a parent material of a magnesium master alloy. A calcium (Ca)-based additive added into the parent material may include at least one compound containing calcium, for example, calcium oxide (CaO), calcium cyanide ($CaCN_2$), calcium carbide ($CaC_2$), calcium hydroxide ($Ca(OH)_2$) or calcium carbonate ($CaCO_3$).

Referring to FIG. 1, the manufacturing method of magnesium master alloy may include a molten magnesium forming operation S1, an additive adding operation S2, a stirring holding operation S3, a casting operation S4, and a cooling operation S5.

In the molten magnesium forming operation S1, magnesium is put into a crucible and a molten magnesium is formed by melting magnesium. For example, magnesium is melted by heating the crucible at a temperature ranging from about 600° C. to about 800° C. When a heating temperature is less than about 600° C., it is difficult to form molten magnesium. On the contrary, when the heating temperature is more than about 800° C., there is a risk that molten magnesium may be ignited.

In the additive adding operation S2, a Ca-based additive may be added into the molten magnesium which is a parent material. For example, the Ca-based additive may have a size between about 0.1 μm and about 500 μm. It is difficult, from a practical standpoint, to make the size of such an additive less than about 0.1 μm and this entails great cost. In the case where the size of the additive is more than about 500 μm, the additive may not react with the molten magnesium.

For example, the Ca-based additive between about 0.0001 and about 30 parts by weight may be added based on 100 parts by weight of the magnesium master alloy. In the case where the additive is less than about 0.0001 parts by weight, the effects caused by the additive (e.g., hardness increase, oxidation decrease, ignition temperature increase and protective gas decrease) may be relatively small. Also, when the additive is more than about 30 parts by weight, intrinsic characteristics of magnesium may be weakened.

In the stirring holding operation S3, the molten magnesium may be stirred or held for an appropriate time. For example, the stirring or holding time may be in the range of about 1 to about 400 minutes. If the stirring holding time is less than about 1 minute, the additive is not fully mixed in the molten magnesium, and if it is more than about 400 minutes, the stirring holding time of the molten magnesium may be lengthened unnecessarily.

Meanwhile, in the case where the Ca-based additive is added during the preparation of the magnesium master alloy, a small amount of a protective gas may be optionally provided in addition in order to prevent the molten magnesium from being ignited. The protective gas may use typical $SF_6$, $SO_2$, $CO_2$, HFC-134a, Novec™ 612, inert gas, equivalents thereof, or gas mixtures thereof. However, this protective gas is not always necessary in the present invention, and thus may not be provided.

As described above, in the case where the Ca-based additive is input in the additive adding operation S2 and the stirring•holding operation S3, the amount of the protective gas required during the melting of magnesium may be considerably reduced or eliminated because the ignition temperature is increased by increasing the oxidation resistance of magnesium in the melt. Therefore, according to the manufacturing method of the magnesium master alloy, environmental pollution can be suppressed by eliminating or reducing the amount of protective gas such as $SF_6$ or the like.

Figure 9:
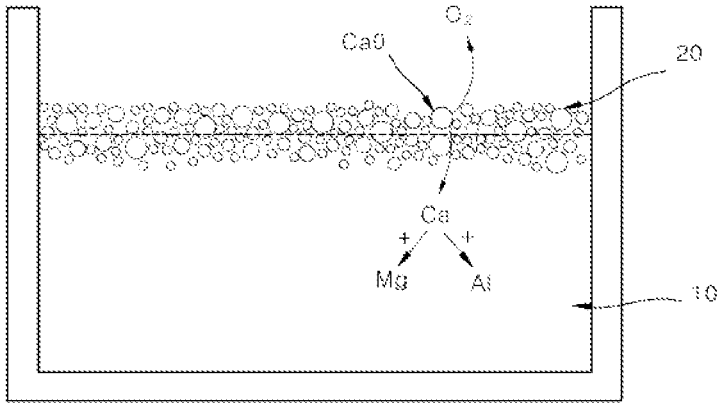
FIG. 9 is a schematic diagram illustrating the decomposition of CaO at an upper portion of the molten magnesium when CaO is added into the molten magnesium.

Meanwhile, as illustrated in FIG. 9, calcium oxide 20, at an upper part of the molten magnesium 10, may become decomposed into oxygen and calcium during the stirring holding operation S3. The decomposed oxygen is emitted out of the molten magnesium in a gas (O2) state or floats as dross or sludge at the top of the molten magnesium. On the other hand, the decomposed calcium reacts with other elements in the molten magnesium to thereby form various compounds.

Therefore, to activate the decomposition reaction, a reaction environment may be created such that the Ca-based additive molecules may react with each other at the surface of the melt rather than being mixed into the inside of the molten magnesium. The upper part of the molten magnesium may be stirred in order that the Ca-based additive remains at the surface of the melt as long as possible and maintained so that it is exposed to air.

Table 1 represents the measurement results of calcium oxide residues according to a stirring method when calcium oxide is added into the molten magnesium of AM60B. The added calcium oxide was about 70 μm in size, and 5, 10 and 15% by weight of calcium oxide was added, respectively. The methods of upper part stirring, internal stirring, or no stirring of the molten magnesium were chosen as the stirring method. From Table 1, it may be understood that most of the added calcium oxide is reduced to calcium when the upper part of the molten magnesium was stirred unlike the other cases.

TABLE 1

| | | 5 wt % CaO addition | 10 wt % CaO addition | 10 wt % CaO addition |
|---|---|---|---|---|
| CaO residues in alloy | No stirring | 4.5 wt % CaO | 8.7 wt % CaO | 13.5 wt % CaO |
| | Internal stirring of the melt | 1.2 wt % CaO | 3.1 wt % CaO | 5.8 wt % CaO |
| | Stirring of the upper part of the melt | 0.001 wt % CaO | 0.002 wt % CaO | 0.005 wt % CaO |

Hence, the stirring may be performed at the upper part which is within about 20% of the total depth of the molten magnesium from the surface thereof, and desirably, may be performed at the upper part which is within about 10% of the total depth of the molten magnesium. In the case where the stirring is performed at a depth of more than about 20%, it is difficult for the decomposition of the Ca-based additive to occur at the surface of the melt.

At this time, a stirring time may be different according to the state of an inputted powder and melt temperature, and it is preferable to stir the melt sufficiently until the added Ca-based additive is, if possible, completely exhausted in the melt. Herein, "exhaustion" means that the decomposition of the Ca-based additive is substantially completed. Decomposition of the Ca-based additive in the molten magnesium due to the stirring operation and the calcium formed by such decomposition may further accelerate reactions to form various compounds.

After the stirring•holding operation S3 of the molten parent material is completed, the molten magnesium is cast in a mold in operation S4, cooled down, and then a solidified master alloy is separated from the mold in operation S5.

A temperature of the mold in the casting operation S4 may be in the range of room temperature (for example, 25° C.) to about 400° C. In the cooling operation S5, the master alloy may be separated from the mold after cooling the mold to a room temperature; however, the master alloy may also be separated even before the temperature reaches room temperature if the master alloy is completely solidified.

Herein, the mold may be selected from a metallic mold, a ceramic mold, a graphite mold, and equivalents thereof. Also, the casting method may include sand casting, die casting, gravity casting, continuous casting, low-pressure casting, squeeze casting, lost wax casting, thixo casting or the like.

Gravity casting may denote a method of pouring a molten alloy into a mold by using gravity, and low-pressure casting may denote a method of pouring a melt into a mold by applying a pressure to the surface of the molten alloy using a gas. Thixo casting, which is a casting process performed in a semi-solid state, is a combination method that adopts the advantages of typical casting and forging processes. However, the present invention is not limited to a mold type and a casting method or process.

The prepared magnesium master alloy may have a matrix having a plurality of domains with boundaries therebetween, which are divided from each other. At this time, the plurality of domains divided from each other may be a plurality of grains which are divided by grain boundaries, and, as an another example, may be a plurality of phase regions having two of mutually different phases, wherein the plurality of phase regions are defined by phase boundaries therebetween.

Meanwhile, a calcium-based compound formed during the manufacturing process of the master alloy may be dispersed and exist in the matrix of the magnesium master alloy. This calcium-based compound may be one formed through the reaction of the Ca-based additive added in the additive adding operation S2 with other elements, for example magnesium and/or aluminium in the magnesium parent material.

That is, the Ca-based additive is reduced to calcium while adding the Ca-based additive into the molten magnesium, and stirring•holding the mixture. In general, since the Ca-based additive is thermodynamically more stable than magnesium, it is expected that calcium is not separated from the molten magnesium through reduction. However, according to experiments by the present inventors, it was discovered that the Ca-based additive is reduced in the molten magnesium. The reduced calcium may react with the other elements, e.g., magnesium and/or aluminum, in the parent material, thereby forming a calcium-based compound.

Therefore, the calcium-based additive, which is a calcium source used to form a Ca-based compound in the magnesium master alloy, is an additive element added into the molten parent material during the manufacture of a master alloy. The Ca-based compound is a compound newly formed through the reaction of the calcium supplied from the Ca-based additive with the other elements in the parent material.

Calcium has a predetermined solubility with respect to magnesium; however, it was discovered that the calcium, which is reduced from the Ca-based additive in the molten magnesium like the present embodiment, is only partially dissolved in a magnesium matrix and mostly forms Ca-based compounds.

For example, in the case where the parent material of the magnesium master alloy is pure magnesium, the Ca-based compound which is possibly formed may be a Mg—Ca compound, for example, $Mg_2Ca$. As another example, in the case where the parent material of the magnesium master alloy is a magnesium alloy, for example, Mg—Al alloy, the Ca-based compound which is possibly formed may include at least one of a Mg—Ca compound, an Al—Ca compound, and a Mg—Al—Ca compound. For instance, the Mg—Ca compound may be $Mg_2Ca$, the Al—Ca compound may include at least one of $Al_2Ca$ and $Al_4Ca$, and the Mg—Al—Ca compound may be $(Mg, Al)_2Ca$.

It is highly probable that the Ca-based compound is distributed at a grain boundary, i.e., a boundary between grains, or a phase boundary, i.e., a boundary between phase regions. This is because such a boundary is more open and has relatively high energy compared to an inside area of the grain or phase region, and therefore provides a favorable site for nucleation and growth of the Ca-based compound.

Figure 2:
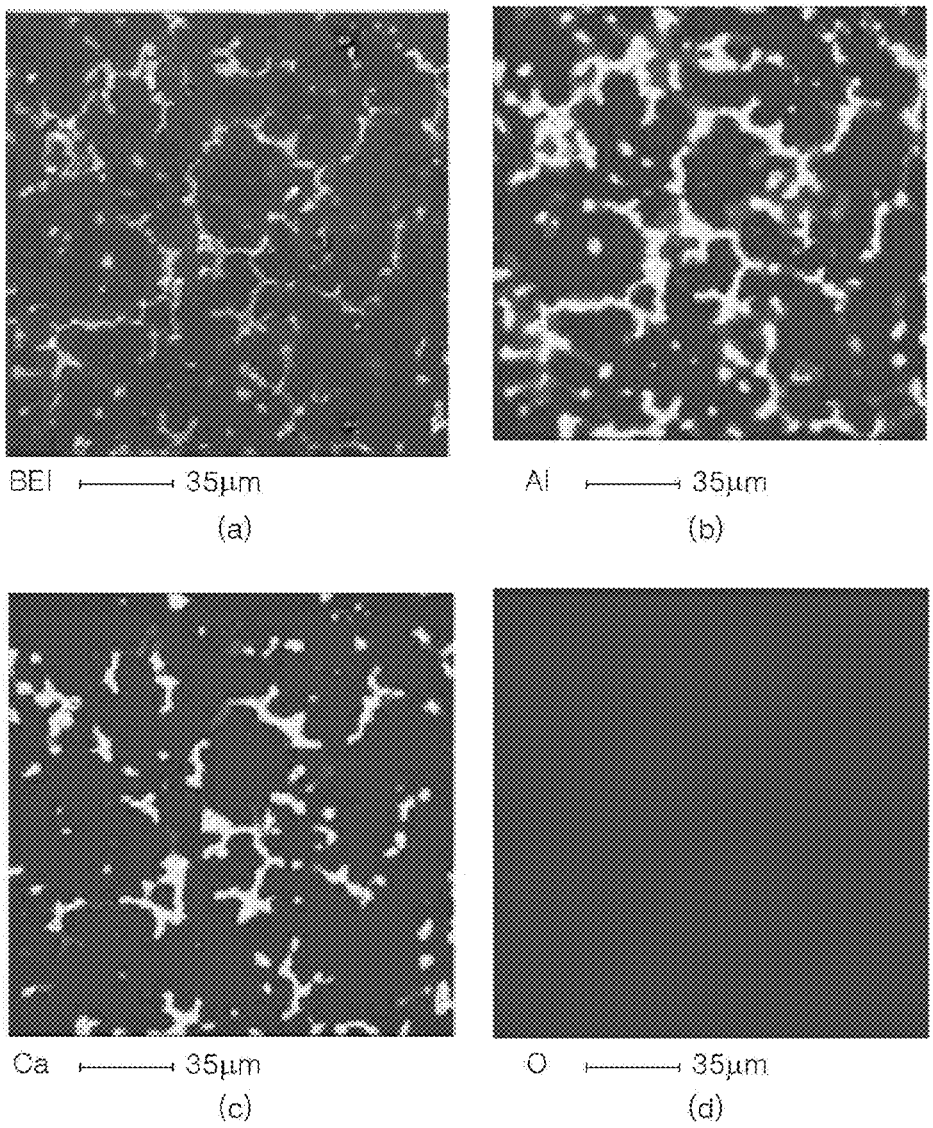
FIG. 2 shows analysis results of microstructures and components of a magnesium master alloy.

FIG. 2 represents the results of Electron Probe Micro Analyzer (EPMA) analysis of the magnesium master alloy which is manufactured by adding calcium oxide (CaO) as a Ca-based compound into a Mg—Al alloy.

Referring to FIG. 2, a microstructure of the magnesium master alloy observed using back scattered electrons is shown in FIG. 2(*a*). As shown in FIG. 2(*a*), the magnesium master alloy includes regions surrounded by compounds (bright areas), to form a polycrystalline microstructure. The compound (bright areas) is formed along grain boundaries. FIGS. 2(*b*) through 2(*d*) show the result of mapping components of the compound region (bright region) by EPMA, that is, the result of showing distribution areas of aluminum (b), calcium (c) and oxygen (d), respectively. As shown in FIGS. 2(*b*) and 2(*c*), aluminum and calcium were detected in the compound, respectively, but oxygen was not detected as shown in FIG. 2(*d*).

Hence, it was shown that an Al—Ca compound, which is formed by reacting Ca separated from calcium oxide (CaO) with Al contained in the parent material, is distributed at grain boundaries of the magnesium master alloy. The Al—Ca compound may be $Al_2Ca$ or $Al_4Ca$, which is an intermetallic compound.

Meanwhile, the EPMA analysis result shows that Al—Ca compound is mainly distributed at grain boundaries of the magnesium master alloy. The Ca-based compound is distributed at grain boundaries rather than the inside regions of grains due to characteristics of the grain boundary having open structures. However, this analysis result does not limit the present embodiment such that the Ca-based compound is entirely distributed at the grain boundaries, and the Ca-based compound may be discovered at the inside regions of grains (in the domains) in some cases.

The magnesium master alloy thus formed may be used for a purpose of being added to an aluminum alloy. As described above, the magnesium master alloy includes the Ca-based compound, which is formed by reacting Ca supplied from the Ca-based additive during an alloying process with Mg and/or Al. All of the Ca-based compounds are intermetallic compounds, and have a melting point higher than the melting point (658° C.) of Al. As an example, the melting points of $Al_2Ca$ and $Al_4Ca$ as Al—Ca compounds are 1079° C. and 700° C., respectively, which are higher than the melting point of Al.

Therefore, in the case where the master alloy containing such a Ca-based compound is inputted to a molten aluminum, the calcium compound may be mostly maintained without being melted in the melt. Furthermore, in the case where an aluminum alloy is manufactured by casting the melt, the Ca-based compound may be included in the aluminum alloy.

A manufacturing method of Al alloy according to an exemplary embodiment will be described in detail below. The manufacturing method may include: providing a magnesium master alloy containing a Ca-based compound and aluminum; forming a melt in which a magnesium master alloy and aluminum are melted; and casting the melt.

For example, in order to form the melt with the Mg master alloy and melted Al, a molten Al is formed first by melting aluminum, and the Mg master alloy containing the Ca-based compound is added into the molten Al and then melted. As another example, a melt may be formed by loading the Al and the Mg master alloy together in a melting apparatus such as a crucible, and heating them together.

Figure 3:
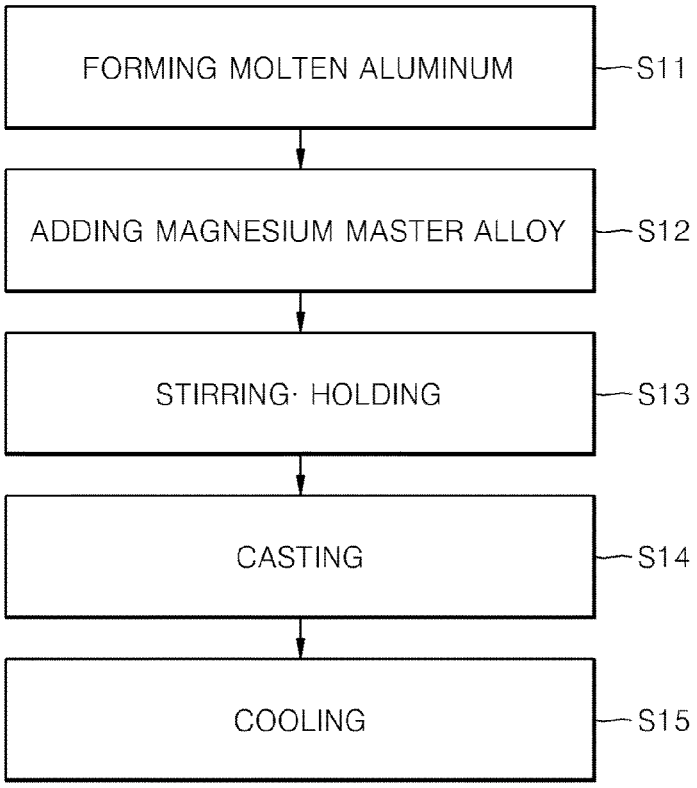
FIG. 3 is a flowchart illustrating an embodiment of a method of manufacturing an aluminum alloy according to the present invention.

FIG. 3 illustrates an exemplary embodiment of a manufacturing method of an Al alloy according to the present invention. Specifically, FIG. 3 is a flowchart illustrating a manufacturing method of an Al alloy by using a process of forming a molten aluminum first, then adding the Mg master alloy manufactured by the above described method into the molten aluminum, and melting the Mg master alloy.

As illustrated in FIG. 3, the manufacturing method of the Al alloy may include a molten aluminum forming operation S11, a Mg master alloy adding operation S12, a stirring•holding operation S13, a casting operation S14, and a cooling operation S15.

In the operation S11, aluminum is put into a crucible and molten Al is formed by heating at a temperature ranging between about 600° C. and about 900° C. In the operation S11, aluminum may be any one selected from pure aluminum, aluminum alloy, and equivalents thereof. The Al alloy, for example, may be any one selected from 1000 series, 2000 series, 3000 series, 4000 series, 5000 series, 6000 series, 7000 series, and 8000 series wrought aluminum, or 100 series, 200 series, 300 series, 400 series, 500 series, and 700 series casting aluminum.

Herein, aluminum alloy will be described more specifically. Various types of Al alloy have been developed for a variety of uses, and the types of Al alloy are classified by the Standard of Aluminum Association of America, which has now been adopted by most countries. Table 2 shows various alloy series in thousands (1000 series aluminum, 2000 series aluminum, etc.) and the composition of main alloying elements for each of the identified alloy series. As shown in Table 3, below, a specific alloy can be further identified by a 4 digit number that identifies further refinements in the alloy by the addition of other improving elements to each alloy series.

TABLE 2

| Alloy series | Main alloying elements |
|---|---|
| 1000 series aluminum | Pure aluminum |
| 2000 series aluminum | Al—Cu—(Mg) series Al alloy |
| 3000 series aluminum | Al—Mn series Al alloy |
| 4000 series aluminum | Al—Si series Al alloy |
| 5000 series aluminum | Al—Mg series Al alloy |
| 6000 series aluminum | Al—Mg—Si series Al alloy |
| 7000 series aluminum | Al—Zn—Mg—(Cu) series Al alloy |
| 8000 series aluminum | The others |

The first number represents an alloy series indicating major alloying element as described above; the second number indicates a base alloy as 0 and indicates an improved alloy as the number 1 to 9; and a new alloy developed independently is given a letter of N. For example, 2xxx is a base alloy of Al—Cu series aluminium, 21xx~29xx are alloys improving Al—Cu series base alloy, and 2Nxx is a case of new alloy developed in addition to the Association Standard. The third and fourth numbers indicate purity of aluminium in the case of pure aluminium, and, in the case of an alloy, these numbers are alloy names of Alcoa Inc. used in the past. For example, in the case of pure Al, 1080 indicates that the purity of aluminium is more than 99.80% Al and 1100 indicates 99.00% Al. The main compositions of such aluminium alloys are as listed in Table 3 below.

TABLE 3

| Grade number | Additive metal (%) Si | Cu | Mn | Mg | Cr | Zn | others | Uses |
|---|---|---|---|---|---|---|---|---|
| 1100 | | 0.12 | | | | | Si 1%, Fe large quantity | Thin metal plate, Kitchen utensil |
| 1350 | | | | | | | The others about 0.5% | Conductive material |
| 2008 | 0.7 | 0.9 | | 0.4 | | | | Metal plate for automobile |
| 2014 | 0.8 | 4.4 | 0.8 | 0.5 | | | | Airplane exterior, Truck frame |
| 2024 | | 4.4 | 0.6 | 1.5 | | | | Airplane exterior, Truck wheel |
| 2036 | | 2.6 | 0.25 | 0.45 | | | | Metal plate for automobile |
| 2090 | | 2.7 | | | | | Li 2.2, Zr 0.12 | Metal for airplane |
| 2091 | | 2.2 | | 1.5 | | | Li 2.0, Zr 0.12 | Metal for airplane |
| 2219 | | 6.3 | 0.3 | | | | V 0.1, Zr 0.18, Ti 0.06 | Metal for spacecraft, Weldable |
| 2519 | | 5.9 | 0.3 | 0.2 | | | V 0.1, Zr 0.18 | Military equipment, Metal for spacecraft, Weldable |
| 3003 | | 0.12 | 1.1 | | | | | General purpose, Kitchen utensil |
| 3004 | | | 1.1 | 1.0 | | | | General purpose, Metal can |
| 3105 | | | 0.6 | 0.5 | | | | Building material |
| 5052 | | | | 2.5 | 0.25 | | | General purpose |
| 5083 | | | 0.7 | 4.4 | 0.15 | | | Heat/pressure-resistant containers |
| 5182 | | | 0.35 | 4.5 | | | | Metal can, Metal for automobile |
| 5252 | | | | 2.5 | | | | Car body exterior use |
| 6009 | 0.8 | 0.33 | 0.33 | 0.5 | | | | Metal plate for automobile |
| 6010 | 1.0 | 0.33 | 0.33 | 0.8 | | | | Metal plate for automobile |
| 6013 | 0.8 | 0.8 | 0.33 | 1.0 | | | | Metal for spacecraft |
| 6061 | 0.6 | 0.25 | | 1.0 | 0.20 | | | General purpose |
| 6063 | 0.4 | | | 0.7 | | | | General purpose, Injection molding |
| 6201 | 0.7 | | | 0.8 | | | | Conductive material |
| 7005 | | | 0.45 | 1.4 | 0.13 | 4.5 | Zr 0.14 | Truck body, Train |
| 7075 | | 1.6 | | 2.5 | 0.25 | 5.6 | | Metal for airplane |
| 7150 | | 2.2 | | 2.3 | | 6.4 | Zr 0.12 | Metal for spacecraft |
| 8090 | | 1.3 | | 0.9 | | | Li 2.4, Zr 0.12 | Metal for spacecraft |

Next, in the operation S12, the Mg master alloy manufactured according to the aforementioned method is added into the molten aluminum.

At this time, the Mg master alloy in the operation S12 may be added at an amount of about 0.0001 to about 30 parts by weight based on 100 parts by weight of aluminum. In the case where the added Mg master alloy is less than about 0.0001 parts by weight, the effects (hardness, corrosion resistance, weldability, etc.) achieved by adding the Mg master alloy may be relatively small. Also, when the Mg master alloy is more than about 30 parts by weight, intrinsic characteristics of aluminum alloy may be weakened.

For example, the Mg master alloy may be added in an ingot form. As another example, the Mg master alloy may be added in various forms such as a powder form and granular form. Size of the Mg master alloy may be selected properly depending on a melting condition, and this does not limit the scope of this exemplary embodiment.

During the addition of the Mg master alloy, the Ca-based compound contained in the Mg master alloy is provided together into the molten aluminum. As described above, the Ca-based compound provided into the molten aluminum may include at least one of a Mg—Ca compound, an Al—Ca compound and a Mg—Al—Ca compound.

At this time, a small amount of a protective gas may be additionally supplied in order to prevent the Mg master alloy from being oxidized. The protective gas may use typical $SF_6$, $SO_2$, $CO_2$, HFC-134a, Novec™ 612, inert gas, equivalents thereof, or gas mixtures thereof, thus enabling the oxidation of the Mg master alloy to be suppressed.

However, this protective gas is not always necessary in this embodiment. That is, in the case where the Mg master alloy contains the Ca-based compound, ignition resistance is increased due to the increase in the oxidation resistance of the Mg master alloy, and the intervention of impurities such as oxide in the melt is reduced remarkably as compared to the case where conventional Mg is added, which does not contain Ca-based compounds. Therefore, according to the Al alloy manufacturing method of this embodiment, the quality of the melt may be improved significantly because the cleanliness of the molten aluminium is greatly improved even without using a protective gas.

Afterwards, in the stirring•holding operation S13, the molten aluminum may be stirred or held for an appropriate time. For example, the molten aluminum may be stirred or held for about 1 to about 400 minutes. Herein, if the stirring holding time is less than about 1 minute, the Mg master alloy is not fully mixed in the molten aluminum. On the contrary, if it is more than about 400 minutes, the stirring holding time of the molten aluminum may be lengthened unnecessarily.

After the operation S13 of stirring holding the molten aluminum is completed, the molten aluminum is cast in a mold in operation S14 and the solidified aluminum alloy is separated from the mold after cooling in operation S15. Temperature of the mold in the operation S14 of casting may be in the range of about room temperature (for example, 25° C.) to about 400° C. In the cooling operation S15, the aluminum alloy may be separated from the mold after cooling the mold to a room temperature; however, the aluminum alloy may be separated even before the temperature reaches room temperature if the master alloy is completely solidified. Explanation about casting methods will be omitted herein since the manufacturing method of the Mg master alloy has been already described in detail.

The aluminum alloy thus formed may be any one selected from 1000 series, 2000 series, 3000 series, 4000 series, 5000 series, 6000 series, 7000 series, and 8000 series wrought aluminum, or 100 series, 200 series, 300 series, 400 series, 500 series, and 700 series casting aluminum.

As described above, since the cleanliness of the molten aluminum is improved in the case of adding the Mg master alloy containing the Ca-based compound, mechanical properties of aluminum alloy are remarkably improved. That is, impurities such as oxides or inclusions, which may deteriorate mechanical properties, are absent in the aluminum alloy casted due to the improvement of cleanliness of the melt, and the occurrence of gas bubbles inside of the casted aluminum alloy is also remarkably reduced. As the interior of the aluminum alloy casted has a cleaner state than the conventional aluminum alloy, the aluminum alloy according to the present invention has mechanical properties superior to the conventional aluminum alloy such that it has not only excellent yield strength and tensile strength but also excellent elongation.

Therefore, although the aluminum alloy having the same content of Mg is manufactured, the cast aluminum alloy may have good properties due to the effect of purifying the quality of the melt according to the present invention.

Also, the loss of Mg added to Al in the melt is reduced. Accordingly, even though an actual addition amount of magnesium is smaller in the present invention than the conventional method, an aluminum alloy can be economically manufactured to substantially have the same content of magnesium as the conventional aluminum alloy.

Further, in the case of adding the Mg master alloy according to the present invention into the molten aluminum, the magnesium instability in the molten aluminum is improved remarkably as compared to the conventional aluminum alloy, thus making it possible to easily increase the content of Mg compared to the conventional aluminum alloy.

Magnesium can be dissolved up to about 15 wt % maximally in aluminum, and the dissolving of Mg into Al leads to an increase in mechanical properties of the aluminum. For example, if magnesium was added to 300-series or 6000-series Al alloy, the strength and elongation of the Al alloy is improved.

However, the quality of a conventional aluminum alloy may be deteriorated since oxides and inclusions caused by Mg are immixed into the melt due to a high oxidizing potential of Mg. This problem becomes more serious as the content of Mg is greater, and thus it was very difficult to stably increase the content of Mg added into the molten aluminum although a protective gas is used.

In contrast, since the Mg master alloy may be added stably into the molten aluminum in the present invention, it is possible to secure the castability while increasing the ratio of Mg by increasing Mg content in aluminum alloy easily as compared to the conventional method. Therefore, since the incorporation of oxides or inclusions is suppressed by adding the Mg master alloy according to the present invention into 300-series or 6000-series Al alloy, the strength and elongation of the Al alloy as well as castability may be improved, and furthermore, it is possible to use 500-series or 5000-series Al alloy which is not practically used at present.

As an example, the aluminum alloy according to the present invention may easily increase the dissolved amount of Mg up to 0.1 wt % or more, and also increase the dissolved amount of Mg up to 5 wt % or more, further up to 6 wt % or more, and even further up to the solubility limit of 15 wt % from 10 wt % or more.

The stability of Mg in the aluminum alloy may act favorably during recycling of aluminum alloy waste. For example, in the case where Mg content is high, during the process of recycling the waste for manufacturing an aluminum alloy, a process (hereinafter, referred to as 'demagging process') for reducing the Mg content to the required ratio is performed. The degree of difficulty and cost of the demagging process are increased as the ratio of required Mg content is lowered.

For example, in the case of 383 Al alloy, it is technically easy to reduce the Mg content up to 0.3 wt %, but it is very difficult to reduce the Mg content up to 0.1 wt %. Also, chlorine gas ($Cl_2$) is used for reducing the ratio of Mg; however, the use of chlorine gas is harmful to the environment, thus leading to an increase in cost.

However, there are technical, environmental and cost advantages since the aluminum alloy, which is manufactured using the Mg master alloy containing the Ca-based compound according to the present invention, enables to maintain the Mg ratio more than 0.3 wt %.

Also, the aluminum alloy according to the present invention may further include an operation of adding a small amount of iron (Fe) during the above-described manufacturing process, for example, after the operation S11 of forming the molten aluminum or the operation S12 of adding the Mg master alloy. At this time, the added amount of Fe may be smaller when compared to the conventional method. That is, in the case of casting an aluminum alloy conventionally, for example, in the case of die-casting an aluminum alloy, a problem of damaging a die often occurred due to soldering between a die made of an iron-based metal and an Al casting material. In order to solve such a problem, about 1.0 to about 1.5% by weight of Fe has been added into an aluminum alloy during the die-casting of the aluminum alloy from the past. However, the addition of Fe may create another problem of deteriorating the corrosion resistance and elongation of the aluminum alloy.

However, the aluminum alloy according to the present invention may contain Mg at a high ratio, and the soldering problems typically associated with conventional die-casted Al alloy case material may be significantly improved even though a considerably small ratio of Fe as compared to the conventional alloy is added. Therefore, it is possible to solve the problem of a decrease in corrosion resistance and elongation, which occurs in the conventional die-cast Al alloy cast material.

The content of Fe added in the process of manufacturing the Al alloy may be less than or equal to about 1.0 wt % (more than 0) with respect to Al alloy, and more strictly be less than or equal to about 0.2 wt % (more than 0). Therefore, Fe with the corresponding composition range may be contained in the matrix of the Al alloy.

The characteristics of the Al alloy manufactured according to the manufacturing method of the present invention will be described in detail below. The Al alloy manufactured according to the manufacturing method of the present invention contains an Al matrix and a Ca-based compound existing in the Al matrix, wherein Mg may be dissolved in the Al matrix. Mg may be dissolved in the range of about 0.1 to about 15 wt % in the Al matrix. Also, Ca of which content is less than the solubility limit, for example less than 500 ppm, may be dissolved in the Al matrix.

As described above, calcium, which was reduced from the Ca-based additive added into the Mg master alloy, exists mostly in the form of Ca-based compounds, and only some are dissolved in a magnesium matrix. In the case where the Mg master alloy is added into the molten aluminum, the amount of calcium dissolved in the matrix of the actual aluminum alloy will also have a small value that is less than the solubility limit, as the calcium dissolved in the Mg master alloy is diluted.

Therefore, in the aluminum alloy according to the present invention, Ca is dissolved in the Al matrix in an amount less than the solubility limit, for example less than 500 ppm, and a microstructure, in which the Ca-based compound is formed separately in the Al matrix, may be obtained.

At this time, the Al matrix may have a plurality of domains which form boundaries therebetween and are divided from each other, and the Ca-based compound may exist at the boundaries or inside the domains. The Al matrix may be defined as a metal structure body in which Al is a major component and other alloying elements are dissolved or other compounds except the Ca-based compound, is formed as a separate phase.

At this time, the plurality of domains divided from each other may be a plurality of grains typically divided by grain boundaries, or may be a plurality of phase regions having two or more different phases, which are defined by phase boundaries.

The Al alloy according to the present invention can improve the mechanical properties in virtue of the Ca-based compound formed in the Mg master alloy. As already described above, when the Mg master alloy is added into the molten aluminium, the Ca-based compound contained in the Mg master alloy is also added into the molten aluminium. The Ca-based compounds are intermetallic compounds which were formed by reacting Ca with other metal elements and have higher melting points than Al.

Therefore, in the case where a master alloy containing such Ca-based compounds is inputted to the molten aluminium, the Ca-based compound may be maintained inside of the melt without being melted. Moreover, in the case of manufacturing the Al alloy by casting such molten aluminium, the Ca-based compound may be included in the Al alloy.

The Ca-based compound may be dispersed and distributed into fine particles in the Al alloy. The Ca-based compound, as an intermetallic compound, is a high strength material as compared to Al which is a matrix, and therefore, the strength of the Al alloy may be increased due to the dispersive distribution of such a high strength material.

Meanwhile, the Ca-based compound may provide a site where nucleation occurs during the phase transition of the Al alloy from a liquid phase to a solid phase. That is, the phase transition from the liquid phase to the solid phase during solidification of aluminium alloy will be carried out through nucleation and growth. Since the Ca-based compound itself acts as a heterogeneous nucleation site, nucleation for phase transition to the solid phase is initiated at the interface between the Ca-based compound and the liquid phase. The solid phase, nucleated in this manner, grows around the Ca-based compound.

In the case where the Ca-based compound is distributed in a dispersive way, solid phases growing at the interface of each Ca-based compound meet each other to form boundaries, and these boundaries may form grain boundaries or phase boundaries. Therefore, if the Ca-based compound functions as nucleation sites, the Ca-based compound exists inside of grains or phase regions, and the grains or phase regions become finer as compared to the case where the Ca-based compound is not present.

Also, Ca-based compound may be distributed at the grain boundaries between grains or the phase boundaries between phase regions. This is because such boundaries have open structures and have relatively high energy compared to inside areas of the grains or phase regions, and therefore, are favorable sites for nucleation and growth of the Ca-based compound.

Thus, in the case where the Ca-based compound is distributed at the grain boundaries or phase boundaries of Al alloy, an average size of the grains or phase regions may be decreased by suppressing the movement of grain boundary or phase boundary due to the fact that this Ca-based compound acts as an obstacle to the movement of grain boundaries or phase boundaries.

Therefore, the Al alloy according to the present invention may have grains or phase regions finer and smaller size on average when compared to the Al alloy that does not contain this Ca-based compound. Refinement of the grains or phase regions due to the Ca-based compound may improve the strength and elongation of the alloy simultaneously.

Also, the aluminum matrix may be selected from 1000 series, 2000 series, 3000 series, 4000 series, 5000 series, 6000 series, 7000 series, and 8000 series wrought aluminum or 100 series, 200 series, 300 series, 400 series, 500 series, and 700 series casting aluminum.

In the Al alloy according to the present invention, the total amount of calcium may comprise between about 0.0001 and about 10 parts by weight based on 100 parts by weight of aluminum. The total amount of calcium is the sum of the amount of Ca which is dissolved in Al matrix and which exists in the Ca-based compound.

Most of Ca present in the Al alloy exists as the Ca-based compound and the amount of Ca dissolved in the Al matrix is relatively small. That is, calcium, which was reduced from the Ca-based additive in the Mg master alloy manufactured by adding the Ca-based additive as described above, will mostly form the Ca-based compound without forming a solid solution in the magnesium matrix. Therefore, in the case where the Mg master alloy is added to manufacture the Al alloy, the amount of the dissolved calcium in Mg master alloy is small, and therefore the amount of calcium dissolved in Al matrix through Mg master alloy is also relatively small, e.g., less than or equal to about 500 ppm.

Meanwhile, the Al matrix may have about 0.1-15% by weight of the dissolved Mg, about 5-15% by weight of the dissolved Mg, about 6-15% by weight of the dissolved Mg, or about 10-15% by weight of the dissolved Mg.

As described above, in the case where the Mg master alloy, which is manufactured by adding the Ca-based additive according to the present invention, is used, the amount of Mg added into the molten Al may be increased stably. Accordingly, the amount of Mg which is dissolved in the Al matrix will be also increased. This increase in the amount of the dissolved Mg may greatly contribute to the improvement of the strength of the Al alloy due to solid solution strengthening and heat treatment, and superior castability and excellent mechanical properties are represented as compared to conventional commercial alloy.

Hereinafter, experimental examples will be provided in order to help understanding of the present invention. The experimental examples described below are only for helping to understand the present invention and the present invention is not limited by the experimental examples below.

Table 4 shows cast properties comparing an Al alloy manufactured by adding the Mg master alloy manufactured with addition of calcium oxide (CaO) as a Ca-based additive into aluminum (Experimental example 1) and an Al alloy manufactured by adding pure Mg without addition of a Ca-based additive in aluminum (Comparative example 1).

Specifically, Al alloy of the experimental example 1 was manufactured by adding 305 g of Mg master alloy into 2750 g of Al, and Al alloy of the comparative example 1 was manufactured by adding 305 g of pure Mg into 2750 g of Al. The Mg master alloy used in the experimental example employs a Mg—Al alloy as a parent material, and the weight ratio of calcium oxide (CaO) with respect to parent material was 0.3.

TABLE 4

| | Experimental example 1 | Comparative example 1 |
|---|---|---|
| Dross amount (impurity floating on the melt surface) | 206 g | 510 g |
| Mg content in Al alloy | 4.89% | 2.65% |
| Melt fluidity | Good | Bad |
| Hardness (HR load 60 kg, 1/16" steel ball) | 92.6 | 92 |

Referring to Table 4, it has been shown that the amount of impurity floating on the melt surface (amount of Dross) represents remarkably smaller value when adding the Mg master alloy (experimental example 1) than when adding pure Mg (comparative example 1). Also, it was shown that Mg content in aluminum alloy is larger when adding the Mg master alloy (experimental example 1) than when adding pure Mg (comparative example 1). Hence, it was shown that the loss of Mg is decreased remarkably in the case of the manufacturing method of the present invention as compared to the method of adding pure Mg.

Also, it was shown that fluidity of the melt and hardness of Al alloy is much improved when the Mg master alloy was added (experimental example 1) than when pure Mg was added (comparative example 1).

Figure 4:
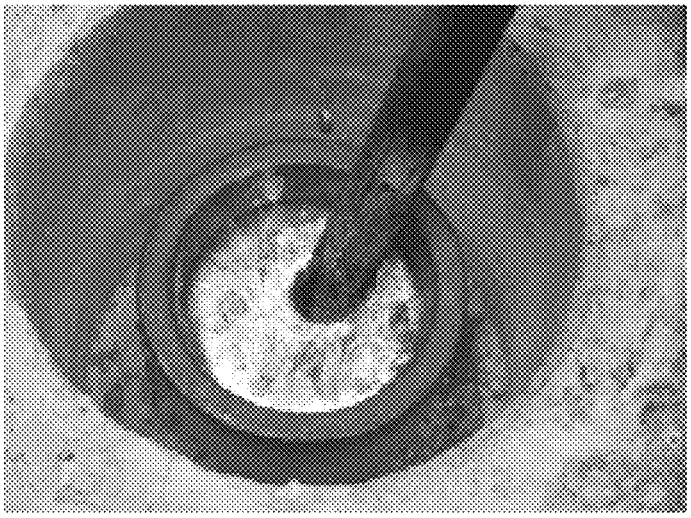
FIG. 4 shows surface images of a molten aluminum alloy (a) in which a master alloy is prepared by adding calcium oxide (CaO) according to an embodiment of the present invention, and a molten aluminum alloy (b) into which pure magnesium has been added.
Figure 4:
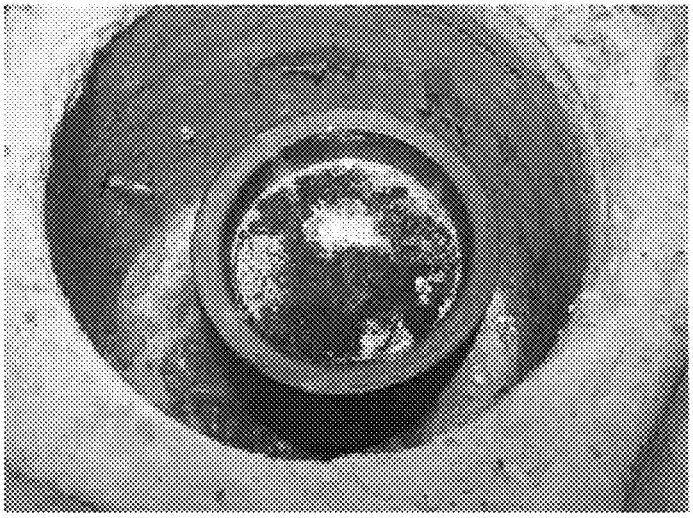

FIG. 4 shows the results of observing the melt condition according to the experimental example 1 and comparative example 1. Referring to FIG. 4, the melt condition is good in the experimental example 1 as shown in (a), but it was shown that the surface of the melt changes to black color due to oxidation of Mg in the comparative example 1 as shown in (b).

Figure 5:
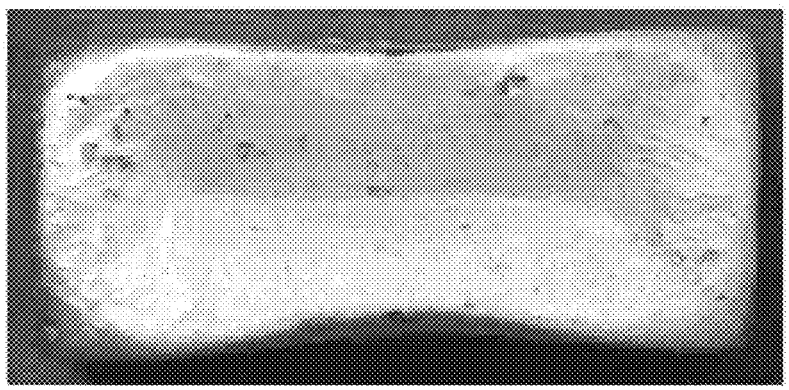
FIG. 5 shows surface images of a casting material for an aluminum alloy (a) from which a master alloy is prepared by adding CaO according to an embodiment of the present invention, and a casting material for a molten aluminum alloy (b) into which pure magnesium has been added.
Figure 5:
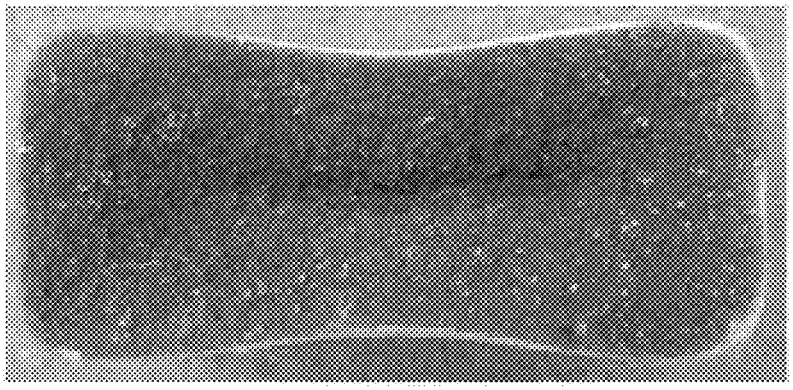

FIG. 5 shows the results of comparing the cast material surfaces of Al alloys prepared according to the experimental example 1 and comparative example 1. Referring to FIG. 5, it was confirmed that the surface of Al alloy casting material wherein the Mg master alloy of the experimental example 1 was added, as shown in (a), is cleaner than that of the Al alloy casting material wherein pure Mg of the comparative example 1 was added, as shown in (b). This is due to the fact that castability is improved by calcium oxide (CaO) added into the Mg master alloy. That is, the Al alloy with pure Al added (comparative example 1) shows ignition marks on the surface due to pure Mg oxidation during casting; however, a clean surface of an aluminum alloy may be obtained due to suppression of the ignition phenomenon in the Al alloy cast using the Mg master alloy with calcium oxide (CaO) added (experimental example 1).

Hence, it may be observed that castability was improved by improvement of quality of the melt in the case of adding Mg master alloy as compared to the case of adding pure Mg.

Figure 6:
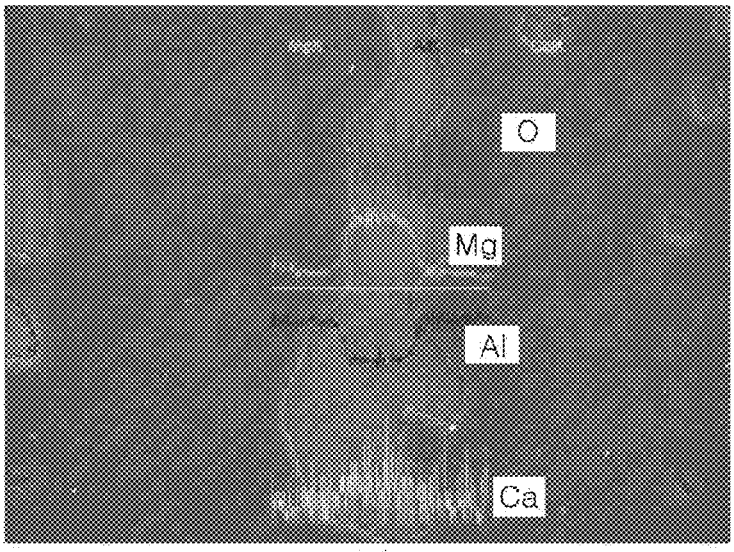
FIG. 6 shows analysis results on components of an aluminum alloy (a) obtained by adding a master alloy with CaO according to an embodiment of the present invention, and components of a molten aluminum alloy (b) with pure magnesium added.
Figure 6:
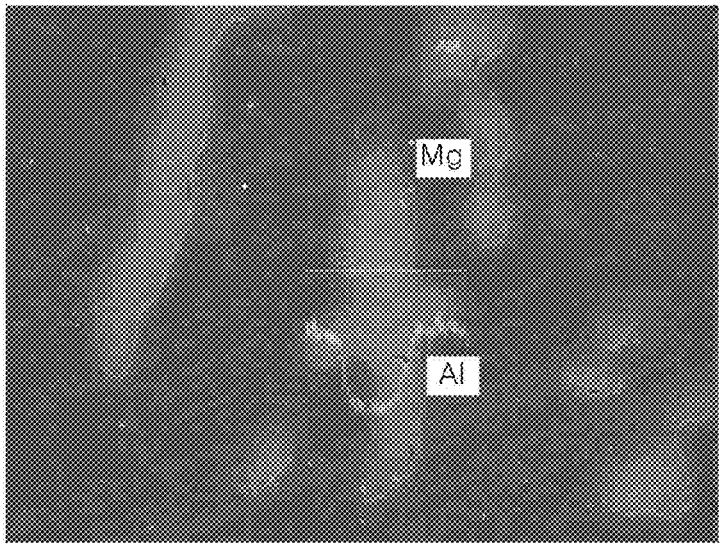

FIG. 6 shows the result of energy dispersive spectroscopy (EDS) analysis of Al alloys according to the experimental example 1 and comparative example 1 using a scanning electron microscopy (SEM). Referring to FIG. 6, only Mg and Al are detected in the Al alloy in which pure Mg of the comparative example 1 was added, as shown in (b). On the other hand, the presence of Ca is confirmed in the Al alloy in which the Mg master alloy having calcium oxide (CaO) of the experimental example 1 was added, as shown in (a). Also, it was shown that Mg and Al are detected at the same position and oxygen was barely detectable. Hence, it is believed that calcium exists as a Ca-based compound by reacting with Mg and/or Al after reducing from calcium oxide (CaO).

Figure 7:
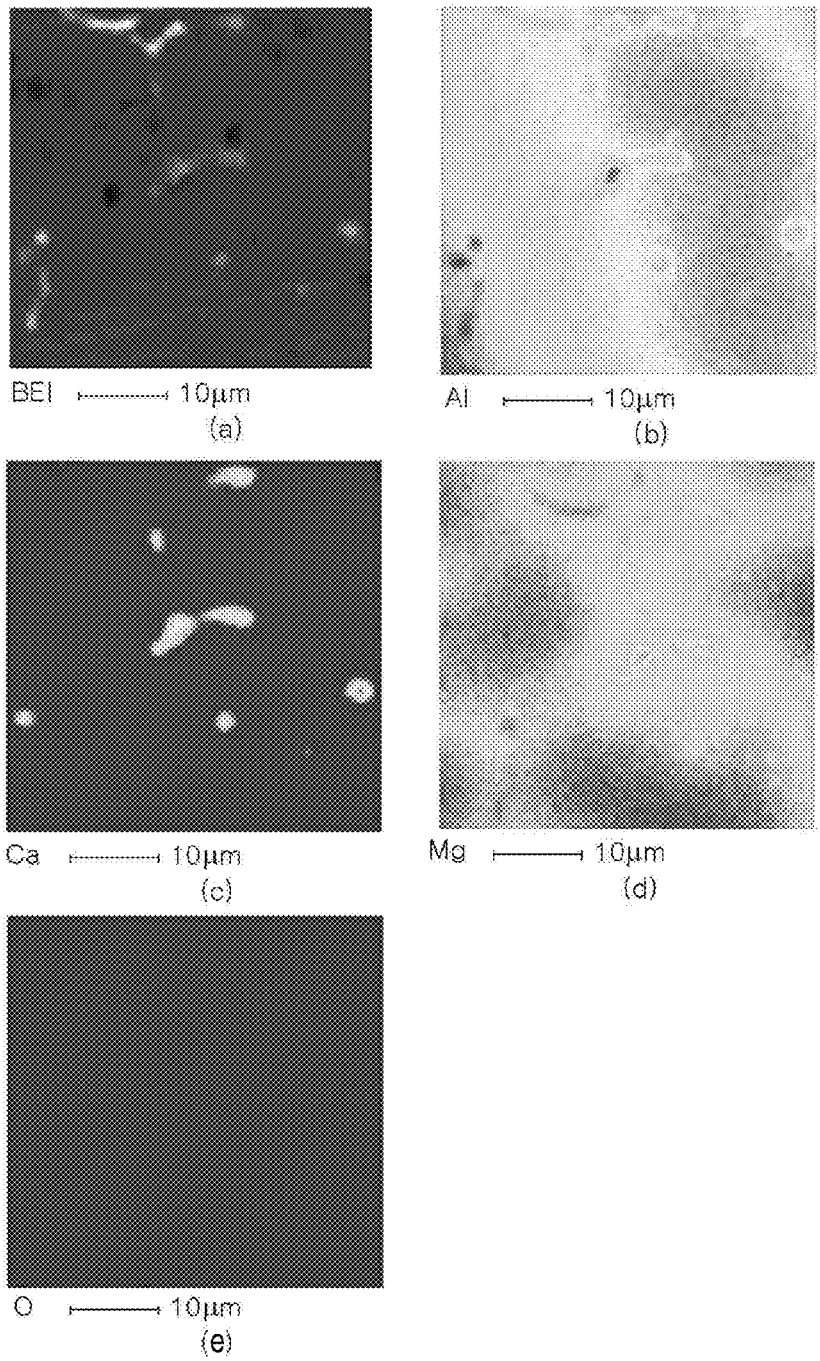
FIG. 7 shows an EPMA observation result (a) of a microstructure of an Al alloy obtained by adding a master alloy with CaO added according to an embodiment of the present invention, and component mapping results (b) to (e) of aluminum, calcium, magnesium and oxygen, respectively, using EPMA.

In FIG. 7(*a*), the EPMA observation result of microstructure of Al alloy of the experimental example 1 is presented, and in FIGS. 7(*b*) through 7(*e*), the respective mapping results of Al, Ca, Mg and oxygen are presented as the component mapping result using EPMA. As understood through FIGS. 7(*b*) through 7(*d*), Ca and Mg are detected at the same position in Al matrix, and oxygen was not detected as shown in FIG. 7(*e*).

This result is the same as the result of FIG. 6(*a*), and hence, it was confirmed again that Ca exists as a Ca-based compound by reacting with Mg and/or Al after reducing from calcium oxide (CaO).

Table 5 shows the mechanical properties comparing Al alloy (experimental example 2 and 3) manufactured by adding the Mg master alloy, in which calcium oxide (CaO) was added to 7075 alloy and 6061 alloy as commercially available Al alloys, with 7075 alloy and 6061 alloy (comparative example 2 and 3). Samples according to experimental example 2 and 3 are extruded after casting, and T6 heat treatment was performed, and data of comparative example 2 and 3 refer to the values (T6 heat treatment data) in ASM standard.

TABLE 5

| | Tensile strength (MPa) | Yield strength (MPa) | Elongation (%) |
|---|---|---|---|
| Experimental example 2 | 670 | 600 | 12 |
| Comparative example 2 | 572 | 503 | 11 |
| Experimental example 3 | 370 | 330 | 17 |
| Comparative example 3 | 310 | 276 | 17 |

As listed in Table 5, it may be known that the aluminum alloy according to the present invention represent higher values in tensile strength and yield strength while superior or identical values in elongation when compared to the commercially available Al alloy. In general, elongation will be decreased relatively in the case where strength is increased in alloy. However, the Al alloy according to the present invention show an ideal property where elongation is also increased together with an increase in strength. As was described above, this result may be related to improvement in the cleanliness of the Al alloy melt.

Figure 8:
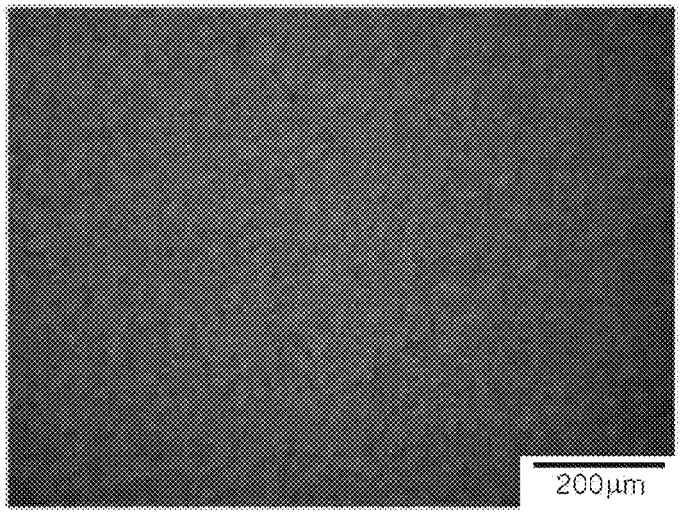
FIG. 8 shows observation results on a microstructure of aluminum alloys (a) manufactured by adding a magnesium master alloy with CaO added into alloy 6061, and a microstructure of alloy 6061 (b) which is commercially available.
Figure 8:
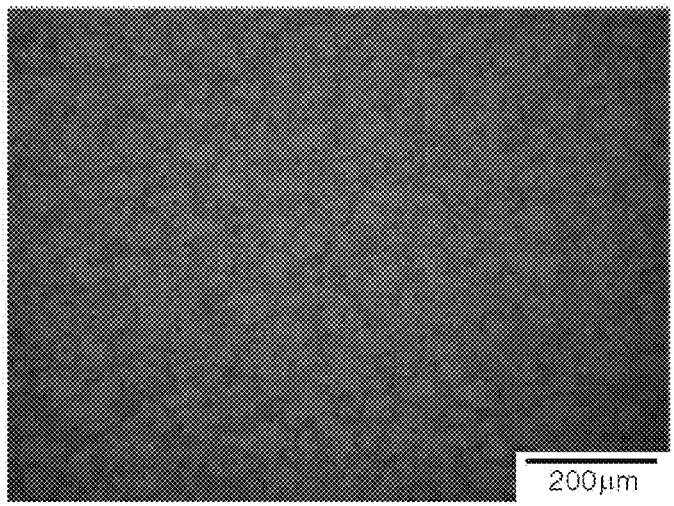

FIG. 8 represents the observation result of microstructures of alloys prepared according to experimental example 3 and comparative example 3. Referring to FIG. 8, it was observed that grains of Al alloy according to the present invention are exceptionally refined as compared to a commercial Al alloy. The grains in the Al alloy in FIG. 8(*a*) according to an embodiment of the present invention have an average size of about 30 μm, and the grains in the commercially available Al alloy in FIG. 8(*b*), according to the comparative example, have an average size of about 50 μm.

Grain refinement in the Al alloy of the experimental example 3 is attributed to the fact that growth of grain boundary was suppressed by the Ca-based compound distributed at grain boundary or the Ca-based compound functioned as a nucleation site during solidification. It is considered that such grain refinement is one of the reasons why the Al alloy according to the present invention shows superior mechanical properties.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of manufacturing an aluminum (Al) alloy, the method comprising:

providing aluminum;

providing a magnesium (Mg) master alloy containing a calcium (Ca)-based compound that is a product of a reaction between a calcium-based additive and at least one material of a parent material melt of pure magnesium or a magnesium-based alloy;

forming a melt in which the magnesium master alloy and the aluminum are melted; and casting the melt to form the aluminum alloy comprising the calcium based compound, wherein aluminum is the most abundant element in the aluminum alloy.

2. The method of claim 1, wherein forming a melt comprises:

forming a molten aluminum by melting the aluminum; and adding the magnesium master alloy into the molten aluminum, and melting the magnesium master alloy.

3. The method of claim 1, wherein forming a melt comprises:

melting the magnesium master alloy and the aluminum together.

4. The method of claim 1, wherein the magnesium master alloy is provided in an amount between about 0.0001 and about 30 parts by weight based on 100 parts by weight of the aluminum.

5. The method of claim 1, wherein the magnesium master alloy comprises aluminum as an alloying element.

6. The method of claim 1, wherein manufacturing the magnesium master alloy comprises:

forming a molten parent material by melting the parent material; and adding the calcium-based additive into the molten parent material.

7. The method of claim 6, wherein the magnesium master alloy is manufactured by:

stirring the molten parent material to exhaust at least some of the calcium-based additive.

8. The method of claim 7, wherein stirring the molten parent material comprises:

stirring the molten parent material at an upper portion less than or equal to 20% of total depth of molten parent material from a surface to substantially exhaust most of the calcium-based additive.

9. The method of claim 1, wherein the magnesium master alloy is manufactured by:

melting the parent material and the calcium-based additive together.

10. The method of claim 1, wherein the calcium-based additive comprises at least one of calcium oxide (CaO), calcium cyanide ($CaCN_2$), calcium carbide ($CaC_2$), calcium hydroxide ($Ca(OH)_2$) and calcium carbonate ($CaCO_3$).

11. The method of claim 1, wherein the at least one material is magnesium or aluminum.

12. The method of claim 11, wherein the calcium-based compound comprises at least one of a Mg—Ca compound, an Al—Ca compound and a Mg—Al—Ca compound.

13. The method of claim 12, wherein the Mg—Ca compound comprises $Mg_2Ca$.

14. The method of claim 12, wherein the Al—Ca compound comprises at least one of $Al_2Ca$ and $Al_4Ca$.

15. The method of claim 12, wherein the Mg—Al—Ca compound comprises $(Mg, Al)_2Ca$.

16. The method of claim 1, wherein an added amount of the calcium-based additive is between about 0.0001 and about 30 parts by weight based on 100 parts by weight of the parent material.

17. The method of claim 1, wherein the aluminum is pure aluminum or an aluminum alloy.

18. The method of claim 1, further comprising adding an amount of iron (Fe) that is greater than 0% and less than or equal to about 1.0% by weight.

19. The method of claim 18, wherein iron is added less than or equal to about 0.2% by weight.

20. The method of claim 1, wherein the aluminum alloy includes the aluminum, the magnesium or the magnesium-based alloy, and 500 ppm or less of the calcium based compound.

21. The method of claim 1, wherein, when casting the melt, the calcium based compound is a nucleation site during solidification.

22. The method of claim 1, wherein the provided aluminum is an alloy.

23. A method of manufacturing an aluminum (Al) alloy, the method comprising:

providing aluminum and a magnesium (Mg) master alloy containing a calcium (Ca)-based compound;

forming a melt in which the magnesium master alloy and the aluminum are melted; and casting the melt, wherein the magnesium master alloy is manufactured by:

adding a calcium-based additive to a parent material of pure magnesium or a magnesium alloy;

forming a molten parent material by melting the parent material;

adding the calcium-based additive into the molten parent material; and stirring the molten parent material at an upper portion less than or equal to 20% of total depth of molten parent material from a surface to substantially exhaust most of the calcium-based additive.

24. A method of manufacturing an aluminum (Al) alloy, the method comprising:

providing aluminum and a magnesium (Mg) master alloy containing a calcium (Ca)-based compound that is a product of a reaction between a calcium-based additive and at least one material of a parent material melt of pure magnesium or a magnesium-based alloy;

forming a melt in which the magnesium master alloy and the aluminum are melted; and casting the melt to form the aluminum alloy comprising the calcium based compound, wherein the magnesium master alloy is manufactured by melting the parent material, adding the calcium-based additive into the molten parent material, and stirring the molten parent material at an upper portion less than or equal to 20% of a total depth of the molten parent material to exhaust a portion of the calcium-based additive.

* * * * *